US005251979A

United States Patent [19]

Larsen

[11] Patent Number: 5,251,979

[45] Date of Patent: Oct. 12, 1993

[54] PAINT CAN COVER WITH MIXER

[76] Inventor: Paul R. Larsen, 2566 Highway F, Baileys Harbor, Wis. 54202

[21] Appl. No.: 918,004

[22] Filed: Jul. 24, 1992

[51] Int. Cl.[5] ..... B01F 7/32

[52] U.S. Cl. ..... 366/248; 366/251; 366/279; 366/605; 366/331

[58] Field of Search ..... 366/244, 245, 246, 247, 366/248, 249, 250, 251, 252, 253, 254, 605, 279, 347, 331

[56] References Cited

U.S. PATENT DOCUMENTS

| | | | |
|---|---|---|---|
| 1,100,937 | 6/1914 | Churn | 366/247 |
| 1,337,362 | 4/1920 | Kennerly | 366/247 |
| 1,508,841 | 9/1924 | Farrington | 366/248 |
| 2,027,297 | 1/1936 | Tramposch | 259/107 |
| 2,162,400 | 6/1939 | Heath | 248/16 |
| 2,351,361 | 6/1944 | Ockrant et al. | 308/15 |
| 2,505,967 | 5/1950 | Humphrey | 259/122 |
| 2,579,874 | 12/1951 | Shaw | 259/107 |
| 3,139,220 | 6/1964 | Darcy | 366/605 |
| 3,139,220 | 6/1964 | Darcy | 222/192 |
| 3,295,836 | 1/1967 | Langella | 366/248 |
| 3,295,836 | 1/1967 | Langella | 259/122 |
| 3,894,723 | 7/1975 | Sanders et al. | 366/248 |
| 3,972,512 | 8/1976 | Grisé et al. | 366/605 |
| 4,151,792 | 5/1979 | Nearhood | 99/348 |
| 4,422,770 | 12/1983 | Geible | 366/605 |
| 4,422,770 | 12/1983 | Geible | 366/248 |
| 4,483,623 | 11/1984 | Eaton et al. | 366/247 |
| 4,488,817 | 12/1984 | Uesaka et al. | 366/247 |
| 4,708,487 | 11/1987 | Marshall | 366/251 |

*Primary Examiner*—Harvey C. Hornsby
*Assistant Examiner*—Reginald L. Alexander
*Attorney, Agent, or Firm*—Jacobson, Price, Holman & Stern

[57] ABSTRACT

A paint can cover or lid having a paint mixing device rotatably supported therefrom and extending into the interior of the paint can for mixing paint in the can while the cover or lid is in place to form a closure for the can. The mixer includes a paddle rotatably supported from the paint can cover or lid and a rotatable member which extends rotatably through the paint can cover or lid in a sealed manner to prevent leakage of paint and entrance of air with the outer end of the rotatable member having a polygonal socket receiving the output of a power device. In one embodiment of the invention, the paint can lid or cover is provided with an opening therein receiving an adapter secured to and sealed to the cover or lid by a threaded nut with the rotatable member extending through the adapter in sealed relation thereto. In another embodiment of the invention, the paint can cover or lid is of one piece plastic construction with a central adapter portion having an opening sealingly receiving and supporting a rotatable member capable of being connected to a power source at its upper end. In each embodiment of the invention, the rotatable member supports a paddle extending to a position adjacent the bottom and peripheral wall of the paint can for thoroughly agitating and mixing paint prior to its use with the cover forming a sealed closure for the paint can to retain all of the paint in the can while the paint is being mixed.

13 Claims, 1 Drawing Sheet

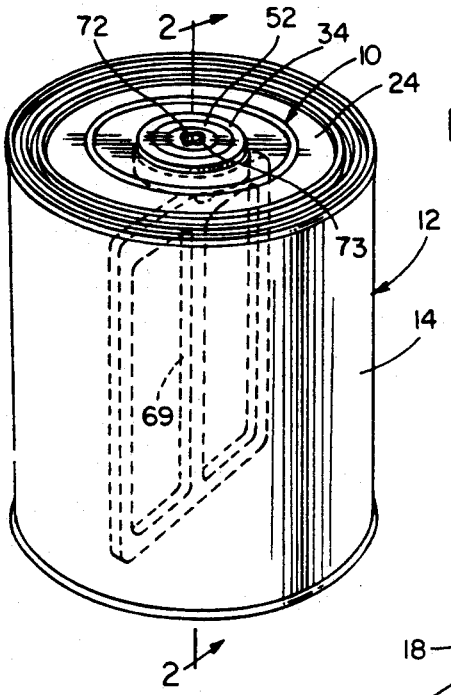
FIG. 1
FIG. 5
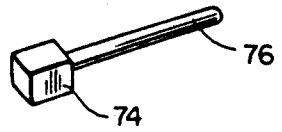
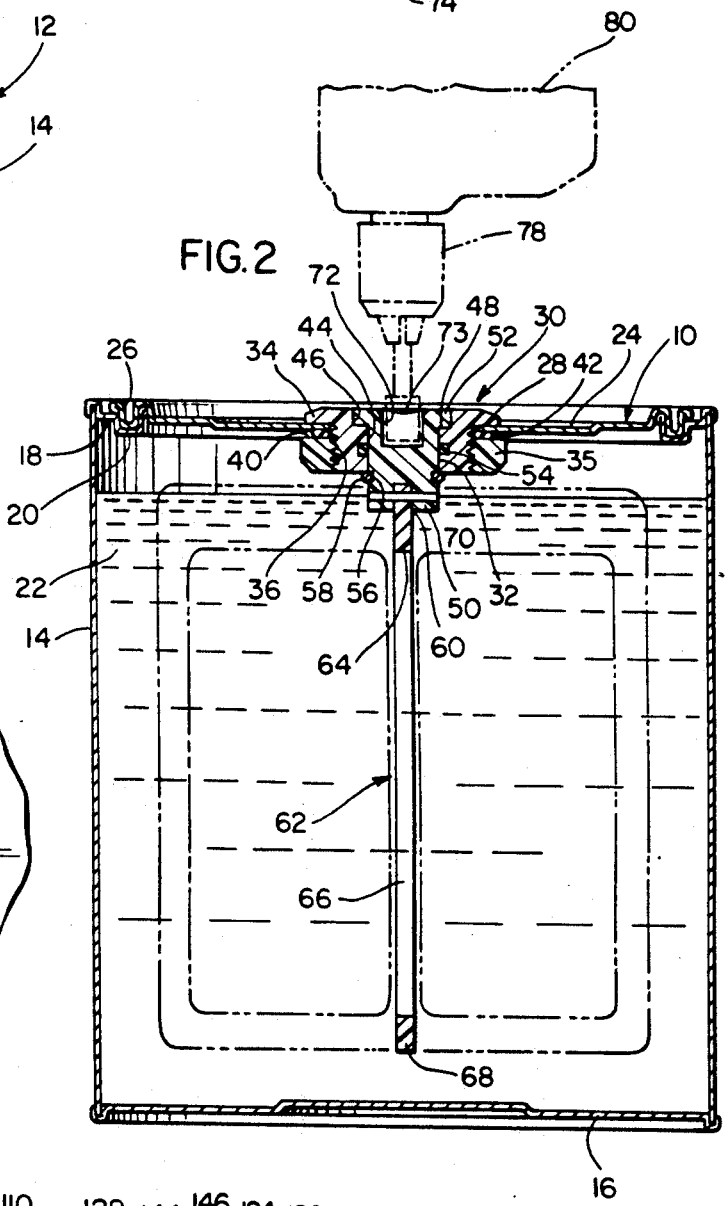
FIG. 2
FIG. 3
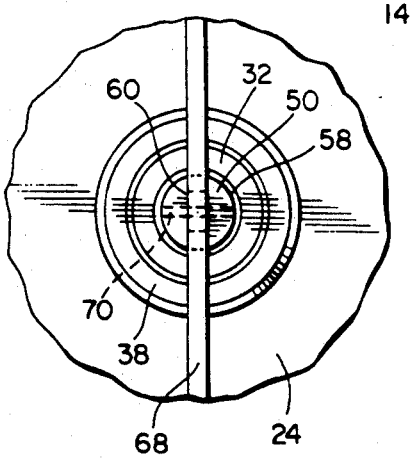
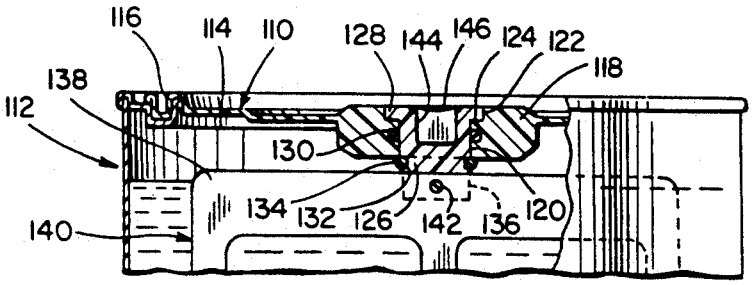
FIG. 4

PAINT CAN COVER WITH MIXER

BACKGROUND OF THE INVENTION

1. Field of the Invention

The present invention generally relates to the provision of a paint can cover or lid having a paint mixing device rotatably supported therefrom and extending into the interior of the paint can for mixing paint in the can while the cover or lid is in place to form a closure for the can. The mixer includes a paddle rotatably supported from the paint can cover or lid and a rotatable member which extends rotatably through the paint can cover or lid in a sealed manner to prevent leakage of paint and entrance of air with the outer end of the rotatable member having a polygonal socket receiving the output of a power device. In one embodiment of the invention, the paint can lid or cover is provided with an opening therein receiving an adapter secured to and sealed to the cover or lid by a threaded nut with the rotatable member extending through the adapter in sealed relation thereto. In another embodiment of the invention, the paint can cover or lid is of one piece plastic construction with a central adapter portion having an opening sealingly receiving and supporting a rotatable member capable of being connected to a power source at its upper end. In each embodiment of the invention, the rotatable member supports a paddle extending to a position adjacent the bottom and peripheral wall of the paint can for thoroughly agitating and mixing paint prior to its use with the cover forming a sealed closure for the paint can to retain all of the paint in the can while the paint is being mixed.

2. Description of the Prior Art

Various efforts have been made to facilitate mixing of paint in a paint can including manually manipulated paddles, power driven mixing devices or stirrers and devices which violently shake the can while the paint can cover or lid is in place. The shaker-type mixer is usually found at commercial establishments where paint is stored and sold to customers with the shaking and mixing operation occurring when the customer purchases the paint. Frequently, it occurs that the customer who purchases the paint does not use it immediately which introduces the problem of mixing the paint immediately prior to use.

The following U.S. Pat. Nos. disclose various types of mixing and agitating devices:

1,100,937
1,337,362
1,508,841
2,027,297
2,162,400
2,351,361
2,505,967
2,579,874
3,139,220
3,295,836
4,151,792
4,422,770

While the above patents disclose various structures for mixing materials within a container including rotatable members which extend through a cover or lid for connection with a power source at an outer or upper end and a device which agitates and mixes material within the can, the prior art does not disclose the specific structure incorporated into the present invention.

SUMMARY OF THE INVENTION

An object of the present invention is to provide a paint can cover with mixer which includes a rotatable member extending through the cover and being rotatably supported from the cover and sealed in relation to the cover to enable effective agitation and mixing of the paint within the can by the use of a power device connected to an upper end of the rotatable member with the structure of the mixer being such that minimal projections exist above the cover to enable the mixer to be incorporated into the paint can when the paint ca is filled with paint thereby enabling the paint can with the mixer of the present invention incorporated therein to be stored and transported in the same manner as conventional paint cans without a mixer.

Another object of the invention is to provide a paint can cover with mixer in accordance with the preceding object in which the cover is provided with a central aperture having an adapter extending therethrough in sealed relation to the cover with the rotatable member extending rotatably through the adapter and sealed in relation to the adapter with the adapter including a flange at its upper end engaging the upper surface of the cover and a nut threaded onto the lower end for clamping engagement with the lower surface of the cover with a seal being provided between the threaded nut and cover and a seal or seals provided between the rotatable member and adapter to effectively prevent egress of paint from the paint can and also prevent ingress of air into the can.

A further object of the invention is to provide a paint can cover with a mixer in which the paint can cover is of one piece plastic construction and includes a central adapter portion having an opening extending therethrough with the rotatable member being received in the opening and sealed in relation thereto thus enabling assembly of the rotatable member with the cover by merely inserting the rotatable member through the opening in the cover.

Still another object of the invention is to provide a paint can cover with mixer in which the mixer includes a generally open rectangular paddle detachably connected to the lower end of the rotatable member with a transverse pin securely connecting the paddle to the rotatable member for thoroughly agitating and mixing the contents of the paint can due to the periphery of the paddle being oriented adjacent the bottom and peripheral wall of the paint can.

A still further object of the invention is to provide a paint can cover with mixer which is relatively inexpensive to manufacture and can be incorporated into the paint can when the paint can is filled with paint or can be supplied separately for mounting on a paint can after a conventional paint can cover or lid has been removed.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the paint can cover with mixer of the present invention oriented on a conventional paint can.

FIG. 2 is a vertical sectional view taken substantially upon a plane passing along section line 2—2 on FIG. 1 illustrating the structural details of the paint can cover and mixer.

FIG. 3 is a bottom plan view of the mixer paddle and adapter.

FIG. 4 is a sectional view illustrating another embodiment of the invention in which the cover is of on piece plastic construction and provided with a thickened central adapter portion having an opening extending therethrough which receives a rotatable member.

FIG. 5 is a perspective view illustrating the drive element that can be used to drive the mixer from a power source such as a portable drill motor and chuck.

DESCRIPTION OF THE PREFERRED EMBODIMENTS

Referring now specifically to the drawings, FIGS. 1-3 illustrate one embodiment of the paint can cover with mixer generally designated by reference numeral 10 which is illustrated in combination with a paint can 12 having a cylindrical peripheral wall 14 and a circular bottom 16 with the upper end of the peripheral wall 14 including an annular, inwardly extending flange 18 having an upwardly opening channel 20 therein. The paint can 12 is of conventional construction and is constructed in the usual manner from sheet metal or the like and may have any desired volume for receiving a quantity of paint 22 therein. Conventionally, the paint can 12 is provided with a cover or lid which is removed when the paint in the can is to be used. The paint can cover with mixer of this invention is utilized in lieu of the conventional paint can cover or lid and can be installed at the time the paint can is filled with paint or can be installed on a paint can after a conventional paint can cover or lid has been removed.

The paint can cover with mixer 10 of this invention includes a circular member 24 having a downwardly extending projection 26 adjacent the outer periphery thereof which is telescopically engaged in and retained in the upwardly opening channel 20 in a conventional and well known manner. Centrally of the circular member 24, an opening 28 is formed through the cover 10 to receive an adapter generally designated by reference 30.

The adapter 30 includes an annular body 32 having an outwardly projecting peripheral flange 34 at its upper end with the flange engaging the upper surface of the circular member 24 with the body 32 extending through the opening 28. The portion of the body 32 which extends through the opening 28 is externally threaded as indicated by reference numeral 36 for receiving an internally threaded nut 38 which has a flat upper surface 40 in opposed spaced parallel relation to the downwardly facing flat bottom surface on the flange 34. An O-ring seal 42 is positioned between the flat upper surface 40 on the threaded nut 38 and the lower flat surface of the circular member 24 with the seal being disposed adjacent the external threads on the body 32. Thus, when the nut 38 is tightened on the body 32, the seal 42 which is of resilient material is partially compressed to form an effective seal between the adapter 30 and the circular member 24 forming the paint can cover 10.

The adapter 30 includes a central, cylindrical bore 44 extending therethrough with the upper end of the bore 44 including a larger diameter portion 46 forming a upwardly facing shoulder 48 which extends radially from the bore 44 to the inner end of the larger diameter portion 46 of the bore as illustrated in FIG. 2.

Positioned through the adapter 30 is a rotatable member 50 of cylindrical configuration which is closely received rotatably in the bore 44. The upper end of the rotatable member 50 is provided with a flange 52 which extends radially outwardly from the rotatable member 50 with the flange being received in the large diameter portion 46 of the bore 44 and engaged with the shoulder 48 thus limiting inward movement of the rotatable member 50 in relation to the adapter 30. The interior surface of the bore 46 is provided with an O-ring seal 54 intermediate the length thereof to engage a central portion of the rotatable member 50 which is received in the bore 44 to form a seal between the rotatable member 50 and the body 32. Also, the rotatable member 50 includes a groove 56 immediately adjacent the lower end of the body 32 which receives an O-ring seal 58 which is in contact with the bottom inner corner of the body 32 with the seal 56 bridging the juncture between the outer surface of the rotatable member 50 and the inner surface of the bore 44.

The lower or inner end of the rotatable member 50 is provided with a transverse groove 60 which receives an upper edge portion of a generally rectangular paddle generally designated by reference numeral 62. The paddle 62 includes a top member 64, side members 66 and a bottom member 68 as well as a vertical central member 69 with these members defining a generally rectangular mixing paddle with the space between the side members 66 and the central member 69 forming open areas to effectively mix the paint 22 with the perimeter of the paddle 62 generally conforming with the interior surface of the paint can 14 but oriented in spaced relation thereto as illustrated in FIG. 2. Also as illustrated in FIG. 2, the upper member 64 is received in the groove 60 which extends transversely across the bottom of the rotatable member 50. A transverse pin 70 extends diametrically of the rotatable member 50 and through the groove 60 and the upper edge portion of the member 64 thus securing the paddle to the rotatable member 50. The pin may be a roll pin or other suitable pin which can be inserted and removed to retain the paddle mounted on the rotatable member. This structure enables the paddle to be assembled on the rotatable member immediately prior to use of the cover with mixer of this invention. Thus, the cover and mixer can be stored and transported in a compact condition and then assembled at the point of use. This also enables the lid and paddle to be effectively distributed in a suitable package for display and sale while in disassembled relation with the paddle being easily and quickly connected to the rotatable member when the cover and mixer are assembled.

The upper surface of the rotatable member is provided with a polygonal socket 72 of square configuration for receiving the square lower end 74 of a rod or shaft 76 which is telescoped into and gripped by a chuck 78 forming the output of a portable drill motor 80 or the like. The rod or shaft 76 incorporates a spring or rubber component to absorb initial torque when the motor of the drill starts thus preventing breakage of the shaft. This enables a conventional portable drill motor to be utilized to rotate the rotatable member 50 and the paddle 62. Various other power sources may be used including other portable motors and also manual devices which are drivingly connected to the rotatable member 50. The adapter 30, rotatable member 50, paddle 62 and drive member 74, 76 can all be constructed of plastic material although the drive element could also be constructed of metal and the O-ring seals are of conventional resilient material such as rubber, neoprene or the like and the pin 70 can be plastic or metal. The nut 38 may have radial external notches or sockets to receive a spanner wrench or similar tool for securely tightening the nut to mount the adapter in place and in sealed relation to the circular member 24. Also, the outer upper corner at the periphery of the flange 34 and the lower outer corner of the periphery of the nut 38 may be chamfered to eliminate sharp corners. Also, the thickness of the flange 34 is such that it does not extend upwardly beyond the channel-shaped configuration at the outer periphery of the lid and in the flange 18 on the paint can thereby enabling paint cans to be stacked vertically one on the other as in conventional practice for displaying paint in a retail paint store or the like. FIG. 3 illustrates the concentric relation of the peripheries of the rotatable member 50, the body 32 and the nut 38 as well as the location of the seal 58.

The cover with mixer 10 of this invention provides an effective but yet relatively inexpensive mixer incorporated into a cover or lid for a paint can which can be installed in the paint can when the paint can is filled with paint and sealed with the seal integrity being retained by the seals between the adapter and the paint can cover and between the adapter and rotatable member. This maintains a liquid and airtight seal for the paint can cover or lid but yet enables the paint can to be stored, filled, transported and displayed in a conventional manner. The cover with mixer 10 can be supplied in disassembled relation and easily assembled at the point of use which may be where the paint cans are filled and provided with a cover or lid for transport to a point of sale or point of use or the cover with mixer 10 can be provided in a blister package or hang-type bag supported on a display rack in order that a customer may purchase the cover with mixer in disassembled form and place the assembled cover with mixer on a paint can after the conventional paint can cover or lid has been removed.

The nut 38 may be in the form of a compression fitting used with or without glue for rapid assembly of the compression fitting on a smooth surfaced body 32 of the adapter 30. This will enable rapid and easy assembly of the mixer and lid in a factory assembly line. However, the threaded nut arrangement may be preferable when the mixer is supplied in a blister package or the like for assembly by a customer. Various snap on nut or bushings with and without threads may be used for customer assembly or factory assembly. Also, the mixer without the lid can be supplied to a customer and the customer can pop a hole in the lid that comes with the paint can when the paint is purchased. This arrangement would decrease the cost of assembly. The cover or lid and mixer have been constructed in order that the plugging process of the paint can at the factory would be accomplished at the same time as the mixing apparatus is installed into the cover or lid.

FIG. 4 illustrates another embodiment of the invention generally designated by reference numeral 110 which is associated with a paint can 112 in the same manner as the embodiment of the invention illustrated in FIG. 1. In this embodiment of the invention, the cover with mixer 110 includes a circular member 114 having an integral one-piece channel-shaped projection 116 at the outer periphery thereof which engages with the channel on the flange of the paint can in the same manner as in FIGS. 1-3. Centrally of the circular member 114, there is an integral adapter portion or thickened area 118 that is unitary with the circular member 114. The circular member 114 and the adapter portion or thickened area 118 are constructed of plastic material and may be molded or otherwise formed by using conventional plastic forming techniques. Due to the circular member 114 and the adapter portion 118 being of unitary construction, there is no possibility of leakage between the circular member 114 and the adapter portion 118.

The adapter portion 118 is centrally located and is of circular configuration and provided with a centrally disposed bore 120 of cylindrical configuration extending therethrough with the upper end of the bore 120 including a larger diameter bore portion 122 defining an upwardly facing radial shoulder 124.

Rotatably positioned through the bore 120 is a rotatable member 126 of cylindrical configuration and having close fitting relation to the bore 120. The upper end of the rotatable member 126 is provided with a flange 128 which is received in the larger diameter bore 122 and engaged with the shoulder 124 to limit the inward movement of the rotatable member 126 in relation to the adapter portion 118.

The central area of the bore 120 includes an O-ring seal 130 therein which is in sealing engagement with the outer periphery of the rotatable member 126. Also, the rotatable member extends downwardly and inwardly beyond the flat bottom surface of the adapter portion 118 and includes a peripheral groove 132 receiving an O-ring seal 134 which engages and bridges the juncture between the adapter portion 118 and the rotatable member 126 thus forming a double seal between the rotatable member 126 and the adapter portion 118 of the circular member 114. The lower end of the rotatable member 126 is provided with a transverse groove 136 which receives the upper transverse member 138 of a paddle 140 which is constructed in the same manner as the paddle in FIGS. 1-3. A transverse pin 142 extends diametrically through the lower end of the rotatable member 126 and below the upper end of the groove or slot 136 for securing the paddle 140 to the rotatable member 126. The upper end of the rotatable member 126 is provided with a polygonal socket 144 which is square in configuration for receiving the drive member illustrated in FIG. 5 for rotating the rotatable member 126 in relation to the adapter portion 118 and the circular member 114. The thickness of the adapter portion 118 may vary and the upper surface thereof is disposed below the plane of the upper edge of the paint can and the lower flat surface is only spaced slightly below the inner surface of the circular member 114. The peripheral corner edges of the adapter portion 118 ma be chamfered to eliminate sharp corners and both of the rotatable members 56 and 126 may have outwardly flared upper edge portions in the socket as indicated at 146 in FIG. 4 and 73 in FIGS. 1 and 2 to facilitate insertion of the square drive end 74 on the rod or shaft 76.

The seal rings effectively retain the rotatable member within the bore. However, in order to stabilize the rotatable member and the paddle, the upper transverse member of the paddle and the connecting pin may be configured so that these mechanical components will prevent upper or outward movement of the rotatable member in relation to the adapter 30 or adapter portion 118. The construction of the cover with mixer is such that the minimal extra cost to incorporate the invention into each paint can being distributed will add very little to the total cost of the paint with the added conveniences and advantages rendering the minimal additional cost clearly economically feasible.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A paint can cover with mixer comprising a circular member forming a cover for a paint can, a rotatable member extending through said circular member, means rotatably supporting the rotatable member and sealing the rotatable member in relation to the circular member, said rotatable member having an upper end provided with means receiving rotational power from a power source to rotatably drive the rotatable member, and paddle means mounted on a lower end of said rotatable member and extending into a paint can for mixing paint in the can, said circular member including a central adapter portion having said bore formed therein, said adapter portion including a cylindrical body having a generally cylindrical vertical bore receiving said rotatable member with said rotatable member having a bottom extending below said body, said bore including first seal means mounted therein intermediate the ends in sealing engagement with the rotatable member and second seal means bridging the rotatable juncture between the rotatable member and a bottom end of said cylindrical body, each of said seal means being an O-ring seal, said first seal means being positioned in a groove in said body in communication with said bore and sealingly engaging the periphery of said rotatable member, said second seal means being positioned in a groove in the periphery of said rotatable member and sealingly engaging a lower end of said body, said body including a larger diameter bore at the upper end of said bore with the larger diameter bore defining an upwardly facing shoulder, said rotatable member including a peripheral, radially outwardly extending flange at an upper end thereof, said flange being received in the larger diameter bore and engaging said shoulder thereby limiting inward movement of the rotatable member into said body.

2. The paint can cover with mixer as defined in claim 1 wherein said body includes an externally threaded lower portion having a periphery enabling it to be inserted through the opening in the circular member, an internally threaded nut on the threaded portion of the body member below the circular member, said nut extending radially outwardly beyond said opening and a seal extending peripherally of the opening between the nut and a lower surface of the circular member to form a seal between the adapter and cicular member.

3. A paint can cover with mixer comprising a circular member forming a cover for a paint can, a rotatable member extending through said circular member, means rotatably supporting the rotatable member and sealing the rotatable member in relation to the circular member, said rotatable member having an upper end provided with means receiving rotational power from a power source to rotatably drive the rotatable member, and paddle means mounted on a lower end of said rotatable member and extending into a paint can for mixing paint in the can, said circular member including a generally cylindrical vertical bore receiving said rotatable member, said bore including seal means mounted therein intermediate the ends in sealing engagement with the rotatable member, said circular member including, a central adapter having said bore formed therein, said adapter including a cylindrical body, said circular member having an opening receiving the body therethrough, said body having a peripheral flange at an upper end thereof engaging an upper surface of the circular member adjacent the periphery of the opening therethrough to limit insertion of the body through the opening in the circular member, said body having an externally threaded lower portion having a periphery enabling it to be inserted through the opening in the circular member, an internally threaded nut on the threaded portion of the body member below the circular member, said nut extending radially outwardly beyond said opening and a seal extending peripherally of the opening between the nut and a lower surface of the circular member to form a seal between the adapter and circular member, said body including a larger diameter bore at the upper end of said bore with the larger diameter bore defining an upwardly facing shoulder, said rotatable member including a peripheral, radially outwardly extending flange at an upper end thereof, said flange being received in the larger diameter bore and engaging said shoulder thereby limiting inward movement of the rotatable member into said body, said rotatable member extending downwardly below a bottom end of said nut and body, a peripheral seal bridging the rotatable juncture between the rotatable member and the interior of said bore thus forming a double seal between the rotatable member and body of the adapter.

4. The paint can cover with mixer as defined in claim 3 wherein a lower end of said rotatable paddle includes a transverse groove, said paddle means including a rectangular member having an upper edge secured in said groove, and a diametric pin extending through the lower end of said rotatable member and through the groove and upper edge of said paddle, said pin being insertable to enable assembly of the paddle onto said rotatable member.

5. The paint can cover with mixer as defined in claim 4 wherein said rectangular paddle includes an upper and lower member interconnected by a central member and a pair of side members oriented in spaced relation to provide open spaces in the paddle for agitating and mixing paint in a paint can, the paddle including outer edge portions slightly inwardly from the periphery of the circular member for positioning in a paint can when said circular member is mounted on a paint can.

6. The paint can cover with mixer as defined in claim 5 wherein the means at the upper end of said rotatable member includes a polygonal socket telescopically and releasably receiving a drive member having a polygonal end corresponding in shape to the socket for insertion into the socket.

7. The paint can cover with mixer as defined in claim 1 wherein said body includes a thickened portion in said circular member with said bore extending through the thickened body portion of the circular member, said circular member and adapter portion being constructed of unitary plastic material.

8. The paint can cover with mixer as defined in claim 7 wherein said adapter portion includes an upper surface positioned below the plane of an upper end of the paint can to enable paint cans to be stacked one on top of another.

9. The paint can cover with mixer as defined in claim 7 wherein a lower end of said rotatable member includes a transverse groove, said paddle means including a rectangular paddle having an upper edge secured in said groove, and a diametric pin extending through the lower end of said rotatable member and through the groove and upper edge of said paddle, said pin being insertable to enable assembly of the paddle onto said rotatable member.

10. The paint can cover with mixer as defined in claim 9 wherein said rectangular paddle includes an upper and lower member interconnected by a central member and a pair of side members oriented in spaced relation to provide open spaces in the paddle for agitating and mixing paint in a paint can, the paddle including outer edge portions slightly inwardly from the periphery of the circular member for positioning in a paint can when said circular member is mounted on a paint can.

11. The paint can cover with mixer as defined in claim 7 wherein the means at the upper end of said rotatable member includes a polygonal socket telescopically and releasably receiving a drive member having a polygonal end corresponding in shape to the socket for insertion into the socket.

12. The paint can cover with mixer as defined in claim 3 wherein said means at the upper end of said rotatable member includes a polygonal socket telescopically and releasably receiving a drive member having a polygonal end corresponding in shape to the socket for insertion into the socket.

13. The paint cover with mixer as defined in claim 3 wherein said paddle means includes a rectangular paddle constructed with an upper and lower member interconnected by a central member and a pair of side members oriented in spaced relation to provide open spaces in the paddle for agitating and mixing paint in a paint can, the paddle including outer edge portions slightly inwardly from the periphery of the circular member for positioning in a paint can when said circular member is mounted on a paint can.

* * * * *